United States Patent [19]

Hoekstra

[11] Patent Number: 5,002,474

[45] Date of Patent: Mar. 26, 1991

[54] SPINNERET FOR DRY SPINNING SPANDEX YARNS

[75] Inventor: Anne Hoekstra, Dordrecht, Netherlands

[73] Assignee: E. I. Du Pont de Nemours and Company, Wilmington, Del.

[21] Appl. No.: 445,958

[22] Filed: Nov. 28, 1989

[51] Int. Cl.[5] ..... B29C 47/12

[52] U.S. Cl. ..... 425/72.2; 264/205; 425/464

[58] Field of Search ..... 425/72.2, 382.2, 461, 425/464, 72.1; 264/177.13, 177.16, 211.14, 103, 204, 205

[56] References Cited

U.S. PATENT DOCUMENTS

| | | | |
|---|---|---|---|
| 1,441,642 | 1/1923 | Tofanelli | 425/464 |
| 1,983,330 | 12/1934 | Welch | 425/464 |
| 2,051,861 | 8/1936 | Jones | 425/464 |
| 2,703,433 | 3/1955 | Holzmann | 425/464 |
| 3,094,374 | 6/1963 | Smith | 264/103 |
| 3,245,112 | 4/1966 | Williamson | 425/464 |
| 3,428,711 | 2/1969 | Hunt | 525/127 |
| 3,454,986 | 7/1969 | Fassbender | 425/382.2 |
| 4,104,015 | 8/1978 | Meyer | 425/464 |
| 4,679,998 | 7/1987 | Dreibelbis et al. | 425/72.2 |

FOREIGN PATENT DOCUMENTS

| | | | |
|---|---|---|---|
| 536574 | 10/1931 | Fed. Rep. of Germany | 425/464 |

*Primary Examiner*—Jay H. Woo
*Assistant Examiner*—James P. Mackey

[57] ABSTRACT

An improved spinneret for use in dry spinning spandex filaments has coaxial inner and outer rings of grouped orifices. The number of grouped orifices in each ring is equal. Each group of orifices is radially equally spaced from the next preceding or next succeeding orifice group. The spinneret provides spandex yarns with improved decitex uniformity.

3 Claims, 3 Drawing Sheets

SPINNERET FOR DRY SPINNING SPANDEX YARNS

BACKGROUND OF THE INVENTION

1. Field of the Invention

This invention relates to a spinneret for dry spinning spandex yarns. More particularly, the invention concerns an improvement in such a spinneret which results in dry-spun spandex yarns that are more uniform in linear density (i.e., denier or decitex).

2. Description of the Prior Art

The term "spandex", as used herein, has its usual definition, a long-chain synthetic polymer that comprises at least 85% by weight segmented polyurethane.

Dry-spinning of spandex polymer solutions through orifices to form filaments is known. For example, Smith, U.S. Pat. No. 3,094,374, and Hunt, U.S. Pat. No. 3,428,711, disclose such a process in which a spandex polymer is dissolved in a solvent to form a solution which is dry-spun through spinneret orifices in a spinning cell to form filaments. Upon emergence from the spinneret, the filaments are forwarded through a chamber of the cell, in which the solvent is evaporated from the filaments and the filaments are coalesced and adhered to each other to form a unitary thread. The thread is forwarded from the cell to a windup where it is formed into a yarn package.

Some spinnerets used commercially for producing coalesced spandex filaments of low decitex have two coaxial rings of grouped orifices. Such spinnerets are similar to those disclosed by Dreibelbis et al, U.S. Pat. No. 4,679,998. Usually, the number of grouped orifices in the outer ring is greater than the number in the inner ring. The number of individual orifices in each group of grouped orifices is usually three, four, five or six. Dreibelbis states that it is advantageous to space the orifices of each group of grouped orifices in the outer ring closer to each other than those of each group in the inner ring. This spacing was intended to decrease spandex thread power differences between the threads dry-spun from each group of orifices of the inner ring versus those from the outer ring. Usually, the coalesced thread from each orifice group is wound on a separate package. Thus many packages are formed from the threads issuing from one spinneret. In the past, to achieve higher throughput, attempts were made to increase the number of groups of filaments per spinneret, but such techniques often resulted in thread of inferior quality.

The known spinnerets generally have been satisfactory for preparing coalesced spandex filament yarns intended for various knit products. However, when such yarns were dry-spun at relatively low decitex and higher throughputs, their subsequent use in certain types of knitted hosiery too frequently produced "band"defects. Two-feed construction circular knit hosiery, such as that made with alternating courses of nylon and nylon-covered spandex yarns, appear to be especially susceptible to such band defects. The band defects usually were about two to five courses wide and covered a width of about 0.3 to 1 centimeter. One familiar with the art (e.g., Dreibelbis et al) would have suspected that the "band" defects were caused by differences between threadlines issuing from the inner and outer rings of grouped orifices. However, the problem was more complicated. Even when only one yarn was used to knit an entire piece of hosiery (e.g., a complete stocking), band defects were still present.

An object of the present invention is to provide means for producing dry-spun spandex threads that would greatly decrease band defects in circular-knit hosiery.

The present inventor found that band defects could be significantly decreased by dry-spinning the spandex threads with the spinneret of his invention. The use of the spinnerets of his invention rather than prior art commercial spinnerets resulted in less decitex variation along the length of each thread produced from each group of orifices and among threads produced from the inner versus outer rings of grouped orifices. This improvement apparently caused the band defects to be decreased substantially.

SUMMARY OF THE INVENTION

The present invention provides an improved spinneret for use in dry spinning spandex filaments, the spinneret being a plate that has two coaxial rings of grouped orifices, each orifice group consisting of a plurality of individual orifices, the improvement comprising the number of orifice groups in the inner ring and outer rings being equal, the orifice groups in each ring being substantially equally spaced around the circumference of that ring, and each orifice group in a ring being substantially equally radially spaced from each of the two closest orifice groups in the other ring. In a preferred embodiment for making sixteen, five-filament spandex threads from a spinneret, the inner and outer coaxial rings each contain eight, substantially equally spaced apart groups of orifices, each orifice group contains five orifices spaced on a regular pentagonal pattern within the group, and the orifice groups are on a radial spacing of about $\pi/8$ (about 0.393 radian or 22.5 degrees). Preferably, the ratio of the average diameter of the outer coaxial ring to the average diameter of the inner coaxial ring is in the range of about 1.2 to 1.5 .

BRIEF DESCRIPTION OF THE DRAWINGS

The invention will be more readily understood by reference to the drawings wherein.

DETAILED DESCRIPTION OF THE INVENTION

Figure 1:
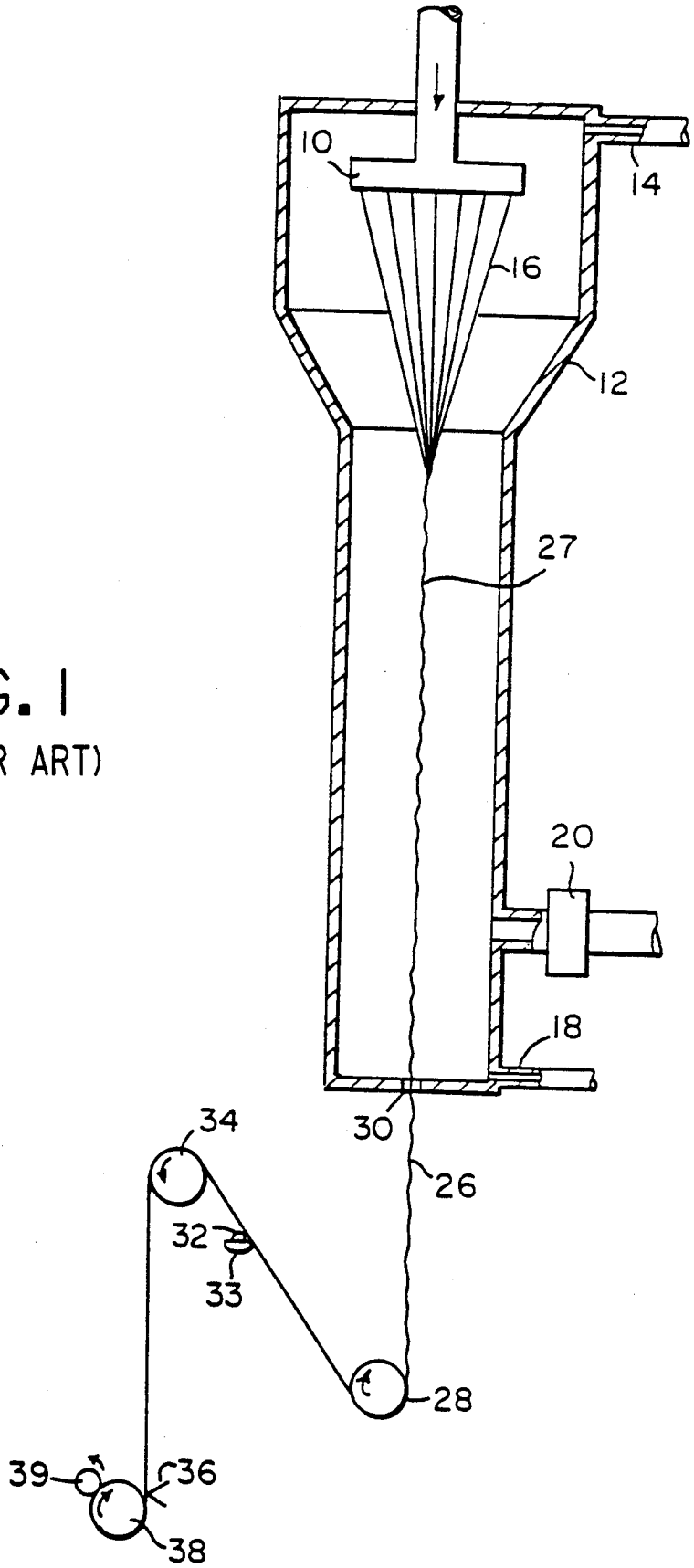
FIG. 1 (PRIOR ART)
FIG. 1 illustrates a prior art apparatus for dry-spinning spandex filaments.

As shown in FIG. 1, in a known process for dry-spinning spandex filaments, a solution of segmented polyurethane in an inert solvent is pumped to spinneret assembly 10 mounted in dry spinning cell 12. As the solution is extruded from the spinneret assembly, it is met by a concurrent stream of hot, inert gas introduced to the cell through inlet 14. Solvent is evaporated from the spinning solution into the hot, inert gas, thereby converting the several streams of spinning solution into continuous filaments 16 as they proceed through the cell. Spandex filaments 16 are converged to form a coalesced multifilament bundle 27. A counter-current stream of inert gas is introduced at the bottom of the cell through inlet 18 to minimize dripping of solvent from the cell. The two streams of inert gas meet and are drawn off through aspiration device 20 near the bottom of the cell.

The coalesced multifilament bundle 27 emerges from the cell through small exit 30 in the form of a unitary thread 26 which then proceeds to feed roll 28. Thread 26 then passes, in succession, over finish roll 32 for application of a lubricant from reservoir 33, to second feed roll 34, and to a wind-up apparatus which consists of traversing guide 36, drive roll 38, and bobbin 39. Roll 34 is operated at a slightly lower, equal, or slightly higher peripheral speed than roll 28, depending upon the desired decitex, spinning speed, and spin-stretch ratio. The relative speed of rolls 28 and 34 is adjusted to overcome friction encountered during finish application at roll 32. The filament bundle may be partially or completely relaxed between roll 34 and roll 38 to give the desired winding tension in the packaged yarn to develop desirable physical properties in the final product.

Figure 2:
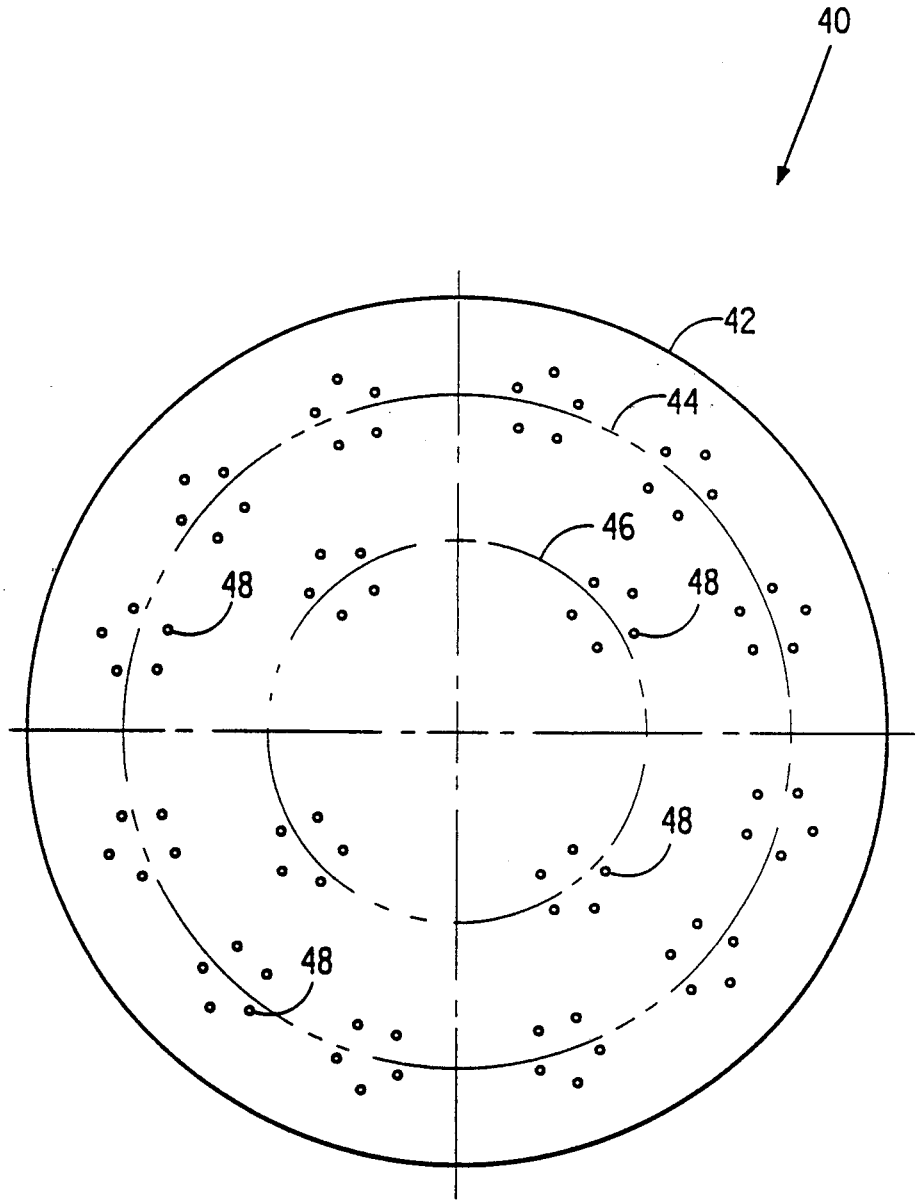
FIG. 2 (PRIOR ART)
FIg. 2 is a plan view of positions of orifices in a prior-art spinneret used for spandex production.

A spinneret, similar to some used commercially for producing sixteen, five-filament spandex threads from one spinneret position, was chosen for purposes of illustrating known spinnerets. The layout of orifices in the spinneret is shown in FIG. 2. Spinneret 40 includes a plate 42 having an outer ring 44 and a coaxial inner ring 46 of grouped orifices, each group containing five orifices 48 arranged in a regular pentagonal array. Outer ring 44 contains twelve groups of orifices and inner ring 46 contains four groups of orifices. Note that the orifice groups in the rings are not evenly spaced radially.

Figure 3:
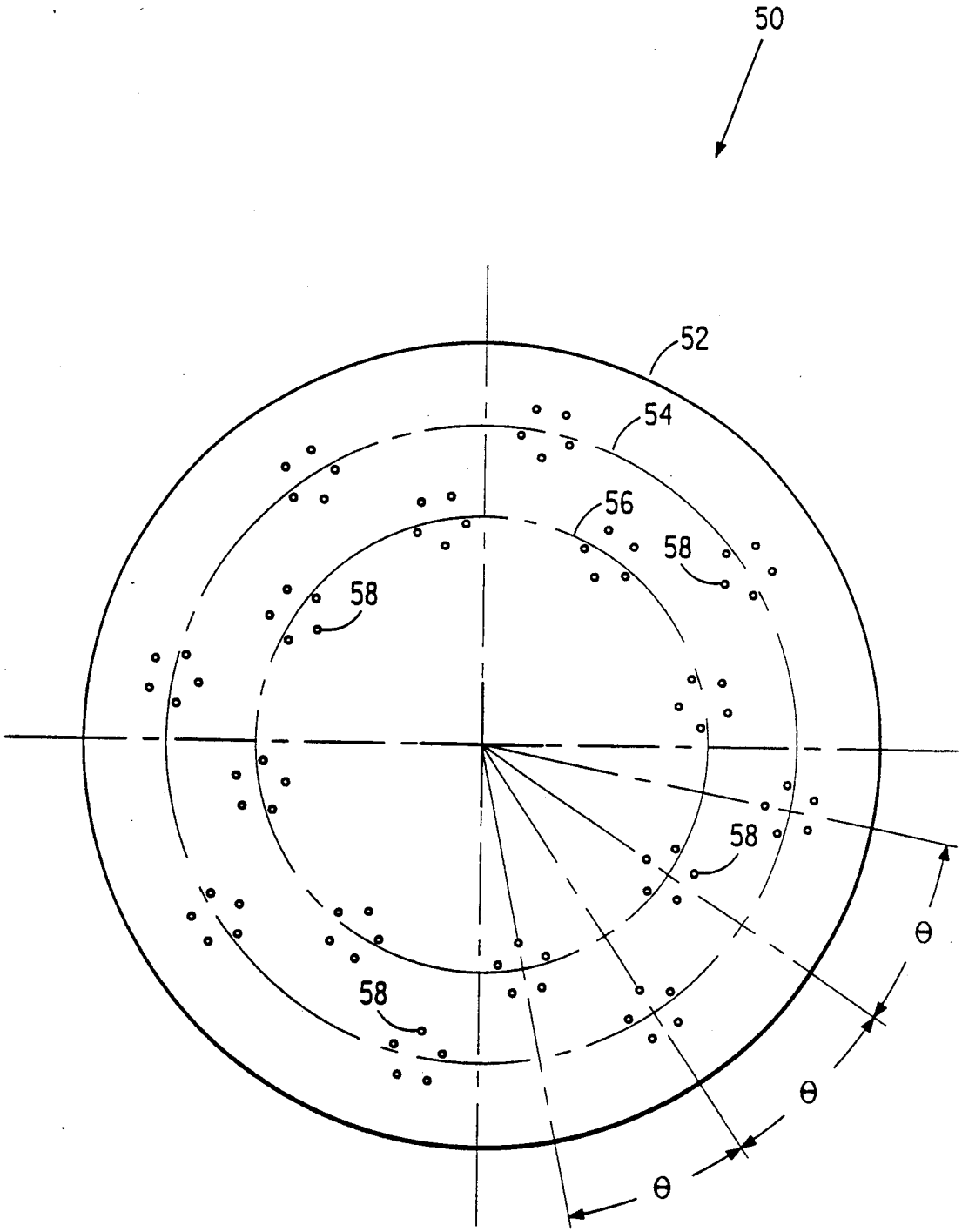
FIG. 3 is a plan view of positions of orifices in a preferred spinneret of the present invention.

A preferred spinneret of the invention for producing sixteen, five-filament spandex threads from one spinneret is shown in FIG. 3. Spinneret of the invention 50 includes a plate 52 having an outer ring 54 and a coaxial inner ring 56, each ring containing eight groups of orifices 58. Each orifice group contains five orifices 58 arrayed in a regular pentagonal pattern. Note that the orifice groups in each ring are evenly spaced circumferentially around the ring and each orifice group is spaced radially about $\pi/8$ (about 0.393 radian or 22.5 degrees) away from the neighboring orifice groups in the outer ring. The ratio of the average diameter of the outer coaxial ring to the average diameter of the inner coaxial ring is about 1.3. This ratio is within the preferred range of about 1.2 to 1.5.

Although the preferred embodiment illustrated in FIG. 3 has five orifices per orifice group, other numbers of orifices per group are quite practical, as for example, 3, 4, or 6 or more).

The advantage of using the spinneret of the invention for producing spandex multifilament threads or yarns is demonstrated in the Examples below with measurements of the coefficient of variation of denier (or dtex) (abbreviated herein "CVD"). CVD is determined from continuous tension measurements on a moving yarn sample. At constant polymer density and yarn modulus, tension correlates with cross-sectional variations in filaments and yarns, which variations are directly proportional to denier variations. CVD, in percent, is calculated by the formula, $CVD(\%) = 100\sigma/M$, in which $\sigma$, the standard deviation and M is the arithmetic mean determined from yarn tension measurements.

A preferred method of continuously measuring tension was used herein. A tensiometer was used to continuously monitor the tension on a yarn sample while the sample was passing between a set of feed rollers rotating at a peripheral velocity of 45.7 m./min. and a set of take up roller rotating at a peripheral velocity of 68.6 m/min. The tensiometer, situated between the sets of rollers, was initially adjusted so that while the yarn is elongated 50% between the sets of rollers, a load of 1 gram was exerted by a 20 denier (20 dtex) yarn and a load of 150 grams was exerted by 2240 denier yarn. During operation, the measured loads were supplied to a microcomputer, programmed to calculate mean, $\sigma$ and CVD values from the supplied data. For yarns of less than 200 denier (220 dtex), the measurements were made continuously for 65 seconds; for yarns of 200 denier (220 dtex) or greater, 120 seconds.

EXAMPLE

This example illustrates the production of spandex filaments with a spinneret of the invention as shown in FIG. 3 and compares the advantage in denier uniformity of the filaments produced with the spinneret of the invention over filaments produced with a known spinneret (as shown in FIG. 2). Both spinnerets were described in detail above with reference to the figures.

A spandex spinning solution was prepared substantially in accordance with the procedures described in Examples I and II of Hunt, U.S. Pat. No. 3,428,711, the disclosure of which is hereby incorporated herein by reference. The solution was extruded through spinnerets having eighty orifices. In one set of runs, the spinneret of the invention of FIG. 3 was employed. In a second set of runs, for comparison purposes, a prior art spinneret of FIG. 2 was employed. For each set of runs, the solution was dry spun into filaments in a spinning cell similar to the one shown in FIG. 1. The threadlines were extruded, coalesced and wound up at substantially the same speed of 1012 yards per minute (925 m/min) in each run to yield 70-denier (78 dtex) yarns. Each yarn was formed from five coalesced 14-denier (15.6-dtex) filaments. The resultant yarns had the following coefficients of variation of denier (CVD):

TABLE

| Variation of Linear Density (dtex) of Yarn | CVD, % | |
|---|---|---|
| | Mean CVD | SD |
| Yarns from Spinneret of invention (FIG. 3) | | |
| Inner ring groups | 10.9 | 2.4 |
| Outer ring groups | 10.4 | 2.1 |
| All groups | 10.6 | 2.2 |
| Yarns from Comparison Spinneret (FIG. 2) | | |
| Inner ring groups | 18.0 | 3.8 |
| Outer ring groups | 11.6 | 3.0 |
| All groups | 13.2 | 4.2 |

In the preceding table, "Mean CVD" is the average coefficient of variation, in percent, of yarn denier (or dtex) and SD is the standard deviation of the mean CVD, also in percent. For each mean CVD value, at least 100 individual random samples were taken from the grouped orifices of each ring. The denier of each sample was measured by the tensiometer-denier procedure and the coefficient of variation of denier of each sample was determined. The CVDs of the samples from the inner ring were averaged to obtain the inner ring groups mean CVD. the CVDs of the outer ring samples were similarly determined. The CVDs of all samples from a given spinneret were similarly averaged to obtain the mean CVD for the entire spinneret.

The data summarized in the table showed that the spinneret of the invention provided a considerable improvement over the comparison commercial spinneret.

Mean values of the coefficient of variation of denier of yarn spun from all the orifices of the commercial comparison spinneret were about 25% worse (more variable) than those of the spinneret of the spinneret of the invention, with the mean CVD of the inner ring of the commercial spinneret being about 65% worse (i.e., more variable) than yarns from the inner ring of the spinneret of the invention. These advantages of the spinneret of the invention over the commercial spinneret are also reflected in the much lower standard deviations of the CVD values for the spinnerets of the invention.

Yarns made in accordance with this example with the spinneret of the invention and with the comparison spinneret were circular knit with a two-feed construction by conventional commercial techniques. The hosiery knit from yarns made with the spinneret of the invention were substantially completely free of "band" defects, but hosiery knit with yarns made with the comparison spinneret had several defects.

I claim:

1. An improved spinneret for use in dry spinning spandex filaments of low textile decitex, the spinneret comprising a plate having a plurality of individual orifices arranged in groups of three, four, five or six orifices, the orifices per group being of equal number, and the orifice groups being circumferentially spaced in a total of two coaxial rings consisting of an inner ring and an outer ring, the improvement comprising the number of orifice groups in the inner ring and in the outer ring being equal, the orifice groups in each ring being substantially equally spaced around the circumference of that ring, and each orifice group in a ring is substantially equally radially spaced from each of the two closest orifice groups in the other ring.

2. A spinneret in accordance with claim 1, for making sixteen, five-filament spandex threads from the spinneret, the inner and outer coaxial rings each containing eight substantially equally spaced apart groups of orifices, each orifice group containing five orifices spaced on a regular pentagonal pattern within the group, and the orifice groups being on a radial spacing of about 22.5 degrees.

3. A spinneret in accordance with claim 2 wherein the ratio of the average diameter of the outer coaxial ring to the average diameter of the inner coaxial ring is in the range of about 1.2 to 1.5.

* * * * *